US009433989B2

(12) United States Patent
Fukuchi et al.

(10) Patent No.: US 9,433,989 B2
(45) Date of Patent: Sep. 6, 2016

(54) HOT PRESS MOLDING METHOD AND HOT PRESS MOLDING DIE

(75) Inventors: Hiroshi Fukuchi, Tokyo (JP); Yuichi Ishimori, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 386 days.

(21) Appl. No.: 14/116,708

(22) PCT Filed: May 22, 2012

(86) PCT No.: PCT/JP2012/063075
§ 371 (c)(1),
(2), (4) Date: Nov. 8, 2013

(87) PCT Pub. No.: WO2012/161192
PCT Pub. Date: Nov. 29, 2012

(65) Prior Publication Data

US 2014/0069162 A1 Mar. 13, 2014

(30) Foreign Application Priority Data

May 23, 2011 (JP) ..... 2011-115176

(51) Int. Cl.
*B21D 22/20* (2006.01)
*B21D 22/02* (2006.01)
(Continued)

(52) U.S. Cl.
CPC ..... *B21D 22/022* (2013.01); *B21D 22/208* (2013.01); *B21D 24/16* (2013.01); *B21D 28/26* (2013.01); *B21D 37/16* (2013.01); *B21D 43/003* (2013.01); *C21D 1/673* (2013.01)

(58) Field of Classification Search
CPC .. B21D 22/022; B21D 37/16; B21D 22/208; B21D 24/16; B21D 28/26; B21D 43/003; C21D 1/673
USPC ..... 72/342.2
See application file for complete search history.

(56) References Cited

U.S. PATENT DOCUMENTS 8,556,619 B2 * 10/2013 Matsen ..... B21D 37/16 249/115
2007/0017272 A1 1/2007 Kurisu et al.
(Continued)

FOREIGN PATENT DOCUMENTS

CN 101394950 A 3/2009
EP 0710884 A1 5/1996
(Continued)

OTHER PUBLICATIONS

Extended European Search Report, dated Nov. 26, 2014, for European Application No. 12790192.4.
(Continued)

*Primary Examiner* — David B Jones
(74) *Attorney, Agent, or Firm* — Birch, Stewart, Kolasch & Birch, LLP

(57) ABSTRACT

The present invention provides a hot press molding method for molding a heated metallic plate (K) using a molding die (20, 60) comprising an upper die (21) and a lower die (20). According to the method, the heated metallic plate is arranged between the upper die and the lower die, the upper die and the lower die are brought together, and the metallic plate held between the dies is pressed. After the metallic plate is pressed, a refrigerant in the form of a liquid or mist is supplied via a plurality of supply holes provided to the lower die to a surface of the metallic plate held between the dies, and once the refrigerant has finished being supplied, a gas is sprayed onto the surface of the metallic plate via the plurality of supply holes. It is thereby possible to remove, with maximum speed, liquid refrigerant adhering to the metallic plate when the supply of liquid refrigerant is stopped.

14 Claims, 6 Drawing Sheets

(51) Int. Cl.

| | |
|---|---|
| ***B21D 24/16*** | (2006.01) |
| ***B21D 28/26*** | (2006.01) |
| ***B21D 37/16*** | (2006.01) |
| ***B21D 43/00*** | (2006.01) |
| *C21D 1/673* | (2006.01) |

(56) References Cited

U.S. PATENT DOCUMENTS

| | | | | |
|---|---|---|---|---|
| 2009/0013749 | A1 | 1/2009 | Ishimori et al. | |
| 2009/0126447 | A1 | 5/2009 | Kondo et al. | |
| 2011/0162424 | A1* | 7/2011 | Seidel | B21D 45/0281 72/11.3 |
| 2014/0083155 | A1* | 3/2014 | Matsen | B29C 70/48 72/342.1 |
| 2014/0295205 | A1* | 10/2014 | Ota | B21D 22/208 428/600 |
| 2014/0352388 | A1* | 12/2014 | Balint | C21D 1/62 72/342.5 |

FOREIGN PATENT DOCUMENTS

| | | | |
|---|---|---|---|
| JP | 2004-249320 | A | 9/2004 |
| JP | 2005-169394 | A | 6/2005 |
| JP | 2006-192480 | A | 7/2006 |
| JP | 2007-075835 | A | 3/2007 |
| JP | 2007-136535 | A | 6/2007 |
| JP | 2008-036709 | A | 2/2008 |
| JP | 2009-125808 | A | 6/2009 |
| JP | 2009-297741 | A | 12/2009 |

OTHER PUBLICATIONS

International Search Report issued in PCT/JP2012/063075, mailed on Aug. 14, 2012.

* cited by examiner

HOT PRESS MOLDING METHOD AND HOT PRESS MOLDING DIE

TECHNICAL FIELD

The present invention relates to a hot press forming method and a hot press forming die of a metal sheet.

BACKGROUND ART

In recent years, as means for shaping steel sheet for auto parts using high strength steel sheet, hot press forming has increasingly been employed. Hot press forming shapes the steel sheet at a high temperature to thereby form it at a stage of a low deformation resistance and then rapidly cools it to quench harden it. With hot press forming, it is possible to press-form parts which are high in strength and are high in shape precision without causing deformation or other shaping problems after shaping.

Specifically, with the hot press forming method, first, steel sheet which has been heated in advance by a heating furnace to a predetermined temperature is supplied to a press die. After this, in a state placed on the bottom die (die) or in a state lifted from the bottom die by lifters or other fixtures built in the bottom die, a top die (punch) is descended to the bottom die limit. Next, the steel sheet is cooled for a certain time (usually 10 seconds to 15 seconds) to cool the steel sheet to a desired temperature. Further, after the cooling finishes, the shaped steel sheet is taken out from the die, then a new steel sheet which has been heated to a predetermined temperature is supplied to the press die. The steel sheet is quenched, tempered, and otherwise heat treated in the cooling process. Therefore, in hot press forming, freely controlling the cooling rate from the viewpoint of the heat treatment characteristics of the steel sheet, obtaining a uniform cooling rate at the steel sheet as a whole from the viewpoint of stability of quality, and shortening the time required for the cooling process after shaping the steel sheet from the viewpoint of productivity, are important.

As means for shortening the cooling time of the shaped steel sheet, it has been proposed to not make the die directly rob heat from the steel sheet, but to feed another medium, for example, water, to the surface of the steel sheet (for example, PLT 1). In particular, in the hot press forming apparatus which is described in PLT 1, the inside surface of the die is provided with a plurality of independent projections of certain heights and channels for water which are communicated with plurality of locations at the inside surface of the die are provided inside the die. Due to this, it is possible to run coolant through the channels inside of the die in the clearances, which are formed by the projections, between the inside surface of the die and the steel sheet. For this reason, it is possible to cool the metal sheet in a short time and raise the productivity of the hot press forming operation. Further, this quenching by rapid cooling enables the steel sheet to be raised in hardness and the strength of the shaped part to be greatly improved.

Further, as means for shortening the time which is required for the cooling process after shaping the steel sheet, it has been proposed to arrange a storage container storing a coolant as close to the steel sheet as possible (for example, PLT 2). In particular, the die which is described in PLT 2 is provided with a storage container which stores a coolant, a plurality of feed holes which feed coolant which is stored in the storage container to the steel sheet, and a coolant feed control device which is provided between the storage container and the feed holes. By having a storage container of coolant arranged inside the die in this way, it is possible to shorten the distance between the storage location of the coolant and feed locations of the coolant. Due to this, it becomes possible to immediately feed coolant to the steel sheet after the control device is sent a coolant feed instruction, and therefore the time from press forming the steel sheet to the end of the cooling process can be shortened.

CITATIONS LIST

Patent Literature

PLT 1: Japanese Patent Publication No. 2005-169394 A
PLT 2: Japanese Patent Publication No. 2007-136535 A

SUMMARY OF INVENTION

Technical Problem

In this regard, in general the heat conduction rate of a liquid is higher than the heat conduction rate of a gas, and therefore when using a liquid state coolant as a coolant for cooling the metal sheet after being pressed, the metal sheet can be cooled quickly compared with the case of using a gas state coolant. From this viewpoint, in both the above PLTs 1 and 2, as the coolant, a liquid, in particular water, is used.

In this regard, when using a liquid state coolant for cooling the metal sheet, even after stopping the feed of the liquid state coolant, the liquid state coolant remains on the surface of the metal sheet. This liquid state coolant does not remain on the entire surface of the metal sheet uniformly, but locally deposits on the surface of the metal sheet. In this case, regions where the liquid state coolant remains are rapidly cooled, while regions where liquid state coolant does not remain are not cooled that much. For this reason, the metal sheet is unevenly cooled and as a result the metal sheet becomes uneven in strength. Further, when using a liquid state coolant comprised of water or another highly corrosive liquid (liquid which easily causes a metal etc. to corrode), if the liquid state coolant remains on the surface of the metal sheet, corrosion of the metal sheet will be invited.

For this reason, to suppress uneven strength or corrosion of a metal sheet, it is considered necessary to remove the liquid state coolant which has deposited on the surface of the metal sheet as quickly as possible after pressing.

Therefore, in consideration of the above problem, an object of the present invention is to provide a hot press forming method and a hot press forming die which can remove the liquid state coolant which has deposited on the surface of the metal sheet as fast as possible when stopping the feed of the liquid state coolant.

Solution to Problem

The inventors studied various hot press forming methods and various hot press forming dies relating to the removal of the liquid state coolant which deposited on the surface of a metal sheet when stopping the feed of the liquid state coolant.

As a result, they discovered that by providing the hot press forming die with a plurality of feed holes able to feed fluid to the metal sheet and by not only feeding liquid state coolant through these feed holes to the surface of the metal sheet, but also blowing a gas on the surface of the metal sheet, it is possible to remove the liquid state coolant which has deposited on the surface of the metal sheet member as fast as possible when stopping the feed of the liquid state coolant.

The present invention was made based on the above findings and has as its gist the following:

(1) A hot press forming method which shapes a heated metal sheet using a forming die which is comprised of a first die and a second die, comprising steps of: arranging the heated metal sheet between the first die and the second die; making the first die and the second die approach to press the metal sheet which is clamped between the two dies; after pressing the metal sheet, feeding liquid state or mist state coolant to the surface of the metal sheet which is clamped between the two dies through a plurality of feed holes which are provided at least at one of the first die and the second die; and, after the coolant finishes being fed, blowing a gas through the plurality of feed holes to the surface of the metal sheet.

(2) The hot press forming method as set forth in (1) wherein the first die and second die are separated before feeding the gas to the surface of the metal sheet.

(3) The hot press forming method as set forth in (1) or (2) wherein a fluid switching means for switching the coolant and the gas which are fed to the plurality of feed holes is provided inside at least one of the first die and second die.

(4) The hot press forming method as set forth in (3) wherein at least one of the first die and the second die has an outside die at which the feed holes are provided and an inside die which is arranged slidably inside the outside die; the outside die is provided inside it with outside pipes which are arranged between a sliding surface between the outside die and the inside die, and the feed holes; the inside die is provided inside it with first inside pipes which are arranged between the sliding surface and a connecting part which is connected to a coolant feed source and with second inside pipes which are arranged between the sliding surface and a connecting part which is connected to a gas feed source; and the fluid switching means makes the outside die and the inside die slide relative to each other to connect the outside pipes with the first inside pipes or second inside pipes and thereby switch between the coolant and the gas which is fed to the plurality of feed holes.

(5) The hot press forming method as set forth in any one of the above (1) to (4) wherein the coolant is either water or anti-rust oil.

(6) A hot press forming die which presses and cools a heated metal sheet, comprising: an outside die provided with feed holes which feed fluid to the metal sheet; and an inside die which is arranged slidably inside the outside die, wherein the outside die is provided inside it with outside pipes which are arranged between a sliding surface between the outside die and the inside die and the feed holes; the inside die is provided inside it with first inside pipes which are arranged between the sliding surface and a connecting part which is connected to a coolant feed source and with second inside pipes which are arranged between the sliding surface and a connecting part which is connected to a gas feed source; and the outside pipes, first inside pipes, and second inside pipes are formed so that the outside pipes can be switched between at least a state connected to the first inside pipes and a state connected to the second inside pipes by making the outside die and the inside die move relative to each other.

(7) The hot press forming die as set forth in the above (6) wherein the outside pipes, first inside pipes, and second inside pipes are formed so that the outside pipes to be switched between a state connected to the first inside pipes, a state connected to the second inside pipes, and a state not connected to the two inside pipes, by making the outside die and the inside die move relative to each other.

(8) The hot press forming die as set forth in the above (6) or (7) wherein the pipeline lengths of the outside pipes are equal.

(9) The hot press forming die as set forth in any one of the above (6) to (8) wherein the die which is comprised of the inside die and the outside die is used as at least one of a top die and bottom die for press forming.

(10) The hot press forming die as set forth in any one of the above (6) to (9) wherein the coolant is any of water, an anti-rust oil, and mists of the same.

Advantageous Effects of Invention

According to the present invention, it is possible to quickly remove the liquid state coolant which was deposited on the surface of a metal sheet at the time of stopping the feed of the liquid state coolant and, as a result, it is possible to suppress uneven strength of the shaped metal sheet and corrosion of the metal sheet.

DESCRIPTION OF EMBODIMENTS

Figure 1:
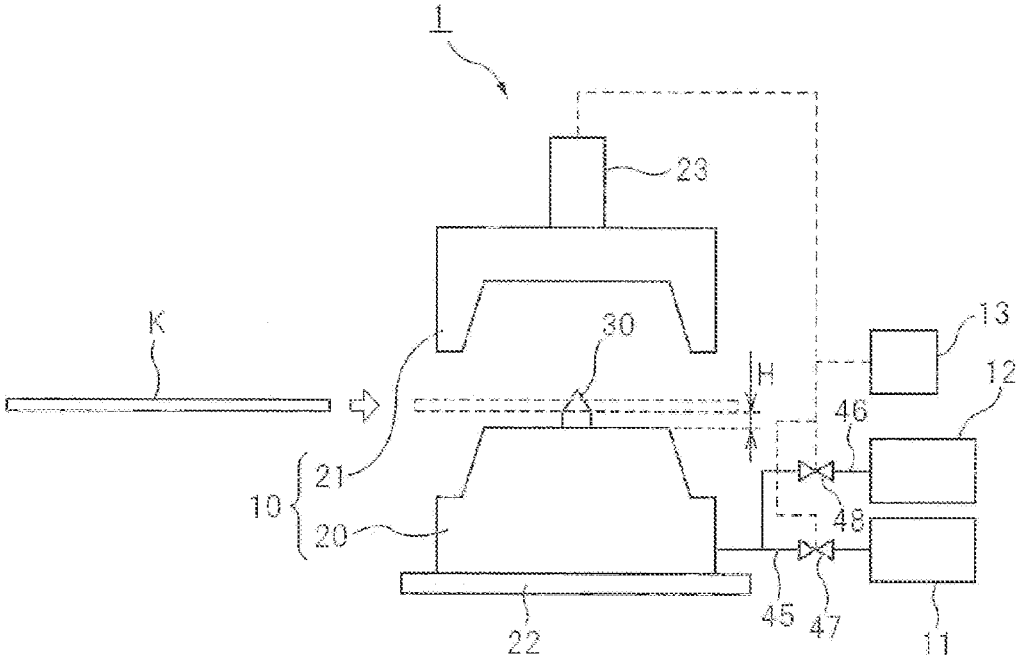
FIG. 1 is a side view which schematically shows the configuration of a hot press forming apparatus.

Below, referring to the figures, embodiments of the present invention will be explained in detail. Note that, in the following explanation, similar components are assigned the same reference numerals.

Figure 2:
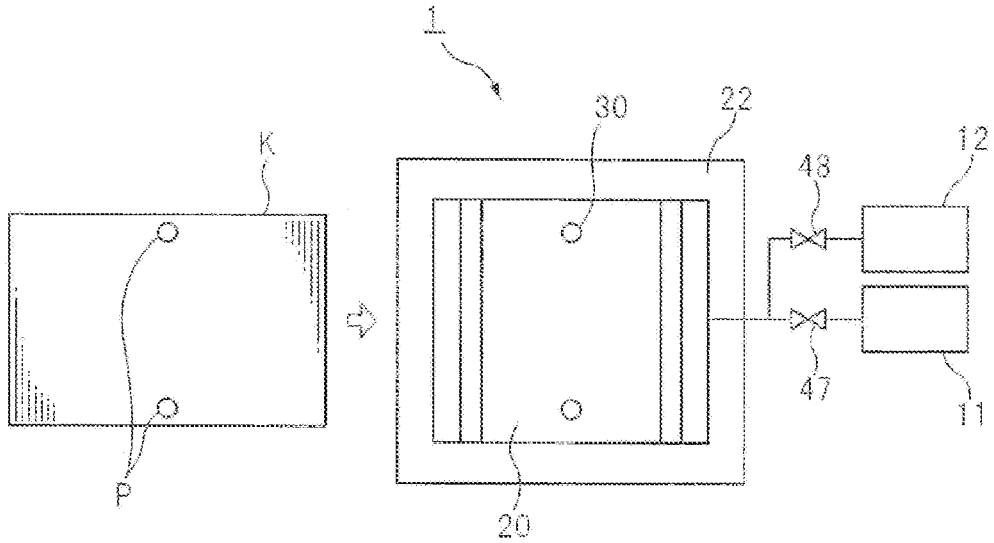
FIG. 2 is a plan view which schematically shows the configuration of the hot press forming apparatus.

FIG. 1 is a side view which schematically shows the configuration of a hot press forming apparatus 1 according to a first embodiment of the present invention. FIG. 2 is a plan view which schematically shows the configuration of the hot press forming apparatus 1.

As will be understood from FIG. 1 and FIG. 2, the hot press forming apparatus 1 comprises a hot press forming die 10 for shaping a steel sheet K, a coolant feed source 11 which feeds coolant (in the present embodiment, water) to the hot press forming die 10, a gas feed source 12 which feeds gas (for example, compressed air) used for being blown to the hot press forming die 10, and a control unit 13 which controls the hot press forming apparatus 1.

The hot press forming die 10 has a bottom die 20 which is disposed in a lower side and a top die 21 which is disposed in a upper side. The bottom die 20 is arranged on the base 22. The top die 21 is arranged vertically above the bottom die 20 and facing the bottom die 20 and is configured to be able to be lifted by a lift mechanism 23 in the vertical direction. The lift mechanism 23 performs a lift operation based on a control signal from the control unit 13.

The bottom die 20 is provided with positioning pins 30 for positioning with prepierced holes P which are preliminarily provided in the steel sheet K. The positioning pins 30 are arranged so as to pass through the inside of the bottom die 20 and stick out vertically upward from the top surface of the bottom die 20.

The top ends of the positioning pins 30 are formed into substantially conical shapes. For this reason, by fitting the top ends of the substantially conical shapes in the prepierced holes P of the steel sheet K, as shown in FIG. 1 by the broken line, the steel sheet K is supported and positioned. In particular, since the top ends of the positioning pins 30 are substantially conical, by suitably setting the sizes of the prepierced holes P of the steel sheet K, the steel sheet K can be supported in a state with a clearance H of a predetermined distance provided from the bottom die 20.

Further, the positioning pins 30 are slidable with respect to the bottom die 20. Further, they are supported at the top surface of the base 22 through not shown biasing means (for example, springs). For this reason, if the top die 21 descends and the positioning pins 30 are pushed down, the steel sheet K is pushed down together with the positioning pins 30.

Figure 3:
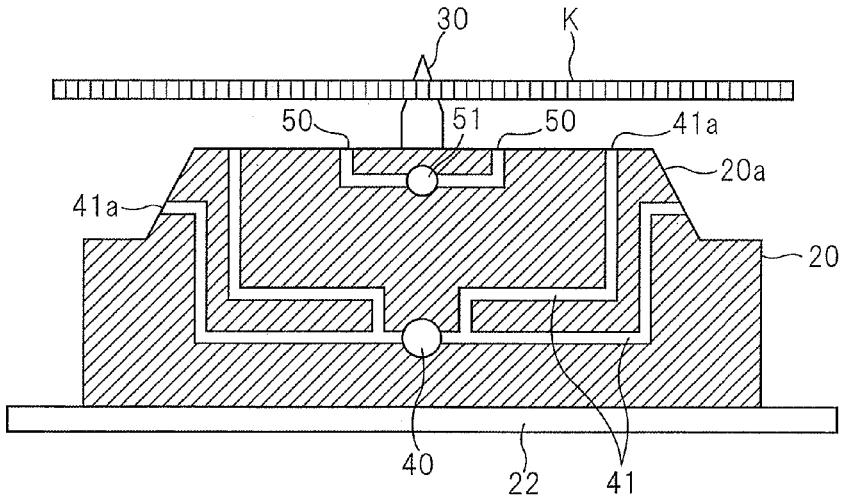
FIG. 3 is a longitudinal cross-sectional view which schematically shows the configuration of a bottom die.
Figure 4:
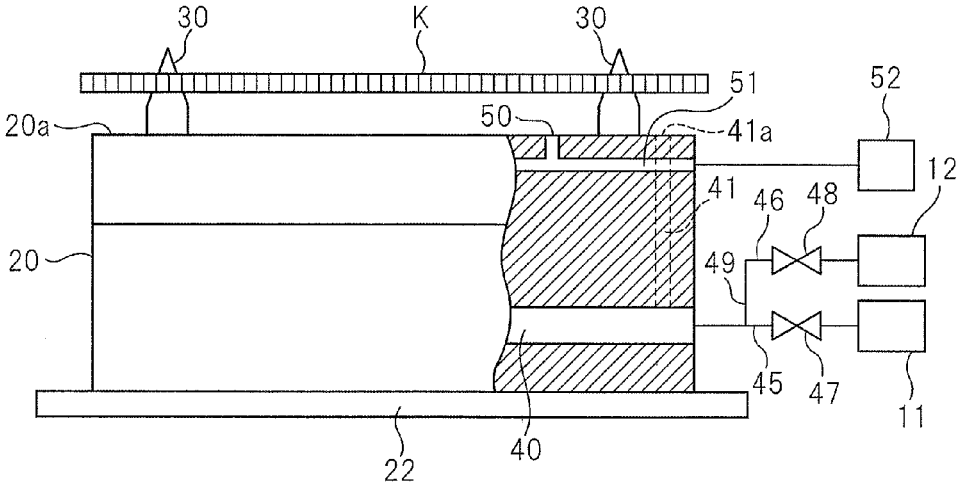
FIG. 4 is a lateral cross-sectional view which schematically shows the configuration of the bottom die.

FIG. 3 is a cross-sectional view when viewing the bottom die 20 from the front direction, while FIG. 4 is a cross-sectional view when viewing the bottom die 20 from the side direction. As shown in FIG. 3 and FIG. 4, the bottom die 20 has a forming surface 20*a* which contacts the steel sheet K at the time of pressing. Inside of the bottom die 20, a header 40 which is connected to the coolant feed source 11 and gas feed source 12, and a plurality of pipes 41 which run through the inside of the bottom die 20 between the header 40 and the forming surface 20*a*, are provided. In the thus configured bottom die 20, the fluid which is fed from the coolant feed source 11 and gas feed source 12 is fed through the header 40 and pipes 41 to the surface of the steel sheet K. Therefore, the ends of the pipes 41 at the forming surface 20*a* sides act as feed holes 41*a* which feed fluid to the surface of the steel sheet K. Note that, in the example which is shown in FIG. 3, to facilitate understanding of the drawing, the feed holes 41*a* are provided at only the left and right sides of the bottom die 20 and are not provided at the center, but in actuality they are preferably arranged evenly over the entire forming surface 20*a* including the center part.

Figure 5:
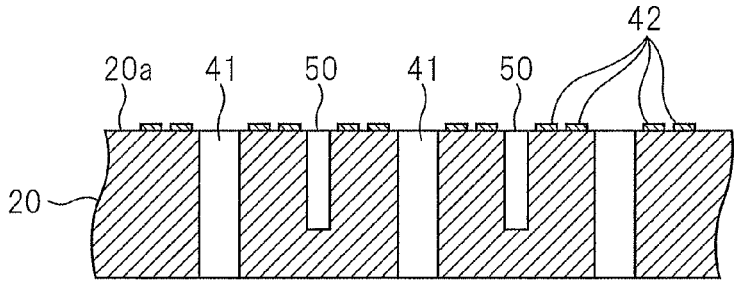
FIG. 5 is a longitudinal cross-sectional view which shows the configuration near a forming surface of the bottom die.

Further, at the forming surface 20*a* of the bottom die 20, as shown in FIG. 5, a plurality of constant height independent projections 42 are formed over the entire surface of the region which faces the steel sheet K. Conversely speaking, the forming surface 20*a* of the bottom die 20 is formed with recesses which are formed between the projections 42 over the entire surface of the region which faces the steel sheet K. Due to this, when the top die 21 pushes down the bottom surface of the steel sheet K to a position which contacts the forming surface 20*a* of the bottom die 20, a clearance is formed between the forming surface 20*a* and the bottom surface of the steel sheet K between the plurality of projections 42. For this reason, by feeding coolant to the clearance from the pipes 41, the steel sheet K can be rapidly cooled.

The header 40, as shown in FIG. 4, is connected through a coolant feed pipe 45 to the coolant feed source 11 and is connected through a gas feed pipe 46 to the gas feed source 12. The coolant feed pipe 45 is provided with a valve 47, while the gas feed pipe 46 is provided with a valve 48. The valve 47 and valve 48 are connected to the control unit 13. The control unit 13 is used to operate the valve 47 and the valve 48 to open and close. Therefore, by operating the valve 47 which is provided at the coolant feed pipe 45, the feed and stopping of the coolant are controlled, while by operating the valve 48 which is provided at the gas feed pipe 46, the feed and stopping of the gas are controlled.

Note that, in the example which is shown in FIGS. 1, 2, and 4, the coolant feed pipe 45 and gas feed pipe 46 are provided with valves 47 and 48. However, the merged part 49 of the coolant feed pipe 45 and the gas feed pipe 46 may be provided with a three-way valve to control the fluid which is fed to the header 40.

Further, in the present embodiment, the forming surface 20*a* of the bottom die 20, as shown in FIG. 3 and FIG. 4, is provided with exhaust suction holes 50 which suck in the coolant etc. which is fed though the feed holes 41*a* to the surface of the steel sheet K and discharge the coolant from around the surface of the steel sheet K. The exhaust suction holes 50 are connected to a suction pipe 51, while the suction pipe 51 is connected to for example a vacuum pump or other exhaust mechanism 52.

Note that, to enable the coolant etc. which is fed from the feed holes 41*a* to be smoothly discharged through the exhaust suction holes 50, the exhaust suction holes 50 should be atmospheric pressure or less. That is, for example, if opening the end of the suction pipe 51 at the opposite side to the exhaust suction holes 50 to the atmosphere, the extraneous coolant around the surface of the steel sheet K will be discharged outside of the die. For this reason, the exhaust mechanism 52 need not necessarily be provided.

Note that, in the present embodiment, water is used as the coolant which is fed from the coolant feed source 11, but aside from water, anti-rust oil which has a rust prevention function or another liquid state coolant may also be used. Further, a mist of water or anti-rust oil etc. or other mist-like coolant can be used. Further, in the present embodiment, as the gas which is fed from the gas feed source 12, compressed air is used, but the invention is not limited to this. For example, so long as a gas which is fed at a pressure of atmospheric pressure or more, nitrogen gas or another gas other than air may be used. In particular, when using nitrogen as the gas which is fed from the gas feed source 12, the surroundings of the steel sheet K may be a nonoxidizing atmosphere, and therefore rusting of the steel sheet K can be further suppressed.

Next, the method of using the thus configured hot press forming apparatus 1 to form steel sheet K by hot press will be explained next.

First, when starting the press forming of the steel sheet K, the valves 47 and 48 are closed. Due to this, the pipes 41 of the bottom die 20 are not fed with either coolant or gas. In such a state, a steel sheet K which has been heated to a predetermined temperature (for example, 700° C. to 1000° C.) is placed by a conveyor apparatus (not shown) between the bottom die 20 and the top die 21. Specifically, the steel sheet K is placed on the positioning pins 30 of the bottom die 20 so that the prepierced holes P fit into the positioning pins 30.

Next, the top die 21 is moved in the vertical direction so as to approach the bottom die 20 to press the steel sheet K which is clamped between the top die 21 and bottom die 20. When the top die 21 descends to the bottom die limit and the press operation is completed, the valve 47 which is provided at the coolant feed pipe 45 is opened. When the valve 47 is opened, coolant is fed from the coolant feed source 11 through the coolant feed pipe 45, header 40, pipes 41, and feed holes 41*a* to the surface of the steel sheet K. Due to this, the steel sheet K starts to be rapidly cooled.

Further, if the top die 21 is held at the bottom die limit for a certain time and the steel sheet K is cooled to a temperature of for example 200° C. or less, next, the valve 47 which is provided at the coolant feed pipe 45 is closed and the valve 48 which is provided at the gas feed pipe 46 is opened. If the valve 48 is opened, the gas is blown from the gas feed source 12 through the gas feed pipe 46, header 40, pipes 41, and feed holes 41*a* to the surface of the steel sheet K. At this time, if the pressure of the gas which is fed from the feed holes 41*a* is too high, the pressurizing energy becomes high, while conversely if too low, gas is no longer evenly ejected from the feed holes 41*a*, and therefore the pressure is set to 0.1 to 1.0 MPa, preferably 0.3 to 0.7 MPa, more preferably 0.4 to 0.5 MPa. The flow rate is determined by the pressure of the gas and the nozzle shape and is set to 20 to 2000 ml/sec, preferably 300 to 1000 ml/sec, more preferably 400 to 700 ml/sec.

Further, the temperature of the gas which is fed from the feed holes 41*a* is set to 200° C. or less, preferably ordinary temperature. That is, the steel sheet K is cooled by the coolant down to 200° C. or less, whereby it is quenched. For this reason, if blowing 200° C. or more gas, the steel sheet K becomes at a temperature of 200° C. or more, the steel sheet K is annealed, and the hardness falls.

Further, in the present embodiment, along with the closing of the valve 47 or the opening of the valve 48, the top die 21 is risen to top die limit. If the top die 21 rises in this way, the positioning pins 30 which had been pushed downward by the top die 21 rise and the steel sheet K is separated from the forming surface 20*a* of the bottom die 20. Due to this, a clearance is formed between the bottom surface of the steel sheet K and the forming surface 20*a* of the bottom die 20.

Further, if blowing gas to the surface of the steel sheet K and thereby finishing removing the coolant on the surface of the steel sheet K, the shaped steel sheet K is taken off by the conveyor apparatus (not shown) from the positioning pins 30 and is unloaded from the hot press forming apparatus 1. Further, a heated new steel sheet K is placed by a conveyor apparatus (not shown) on the positioning pins 30 of the hot press forming apparatus 1 and this series of steps in the hot press forming operation is repeated.

Next, the advantageous effects of the hot press forming die and hot press forming method according to the above embodiment will be explained.

According to the above embodiment, in the state with a steel sheet K placed on the same hot press forming die 10, the surface of the steel sheet K was fed with coolant from the coolant feed source 11 and blown with gas from the gas feed source 12. For this reason, it is possible to blow gas to the surface of the steel sheet K immediately after stopping feeding of the coolant to the surface of the steel sheet K. For this reason, it is possible to quickly remove the coolant which has deposited on the surface of the steel sheet K.

Note that, the time which is taken for removing the coolant which is deposited on the surface of the steel sheet K depends on the temperature and sheet thickness of the shaped steel sheet K (that is, the heat capacity of the steel sheet K). For example, if making the pressure of the gas which is fed from the feed holes 41*a* 0.4 MPa, making the flow rate 60 to 70 ml/sec, and making the temperature ordinary temperature, if the temperature of a sheet thickness 1.4 mm steel sheet K right after pressing is about 150° C., it is possible to remove the coolant which deposited on the steel sheet K in about 3 seconds from the start of blowing of the gas. Further, in the case of sheet thickness 1.2 mm steel sheet K, it is possible to remove the coolant which deposited on the steel sheet K in about 7 seconds from the start of blowing of the gas.

In this way, it is possible to quickly remove the coolant which deposited on the surface of the steel sheet K, and therefore it is possible to suppress uneven cooling of the steel sheet K due to coolant remaining on the surface of the steel sheet K in an uneven manner. Accordingly, it is possible to keep the strength of the steel sheet K from becoming uneven. Further, even when using water as a coolant, it is possible to keep rust from forming due to the coolant which remains on the surface of the steel sheet K.

Further, after being pressed by the hot press forming die 10, the surface of the steel sheet K is sprayed with gas whereby the scale which formed on the surface of the steel sheet K due to the pressing etc. can be removed. In particular, if the coolant is removed from the surface of the steel sheet K and the surface of the steel sheet K is dried, the scale easily peels off, and therefore in the present embodiment, the scale can be removed more efficiently.

Further, in the above embodiment, the clearance H is formed when blowing gas on the surface of the steel sheet K. By such a clearance H being formed, the gas which is fed from the gas feed source 12 through the feed holes 41*a* is easily exhausted and the flow rate of the gas which passes over the surface of the steel sheet K can be raised. Due to this, the coolant which deposited on the surface of the steel sheet K can be efficiently removed. Note that, if the clearance H is too small, it becomes difficult to draw in the surrounding gas while conversely if too large, the blown gas will disperse and the effect of blowing it will fall, and therefore the clearance is 1 mm to 100 mm or so, preferably 5 to 20 mm, more preferably 8 to 15 mm.

Next, referring to FIG. 6 and FIG. 7, a second embodiment of the present invention will be explained. The configuration of the hot press forming apparatus of the second embodiment is basically similar to the configuration of the hot press forming apparatus of the first embodiment. However, in the hot press forming apparatus of the second embodiment, the configuration of the bottom die 60 differs from the configuration of the bottom die 20 of the first embodiment.

Figure 6:
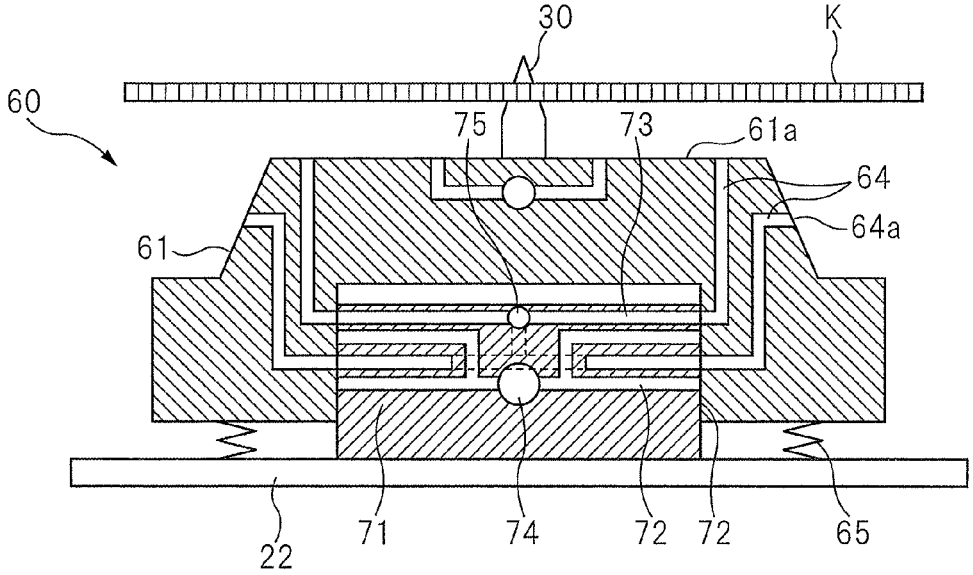
FIG. 6 is a longitudinal cross-sectional view which schematically shows the configuration of the bottom die which is used in a hot press forming die of a second embodiment.
Figure 7:
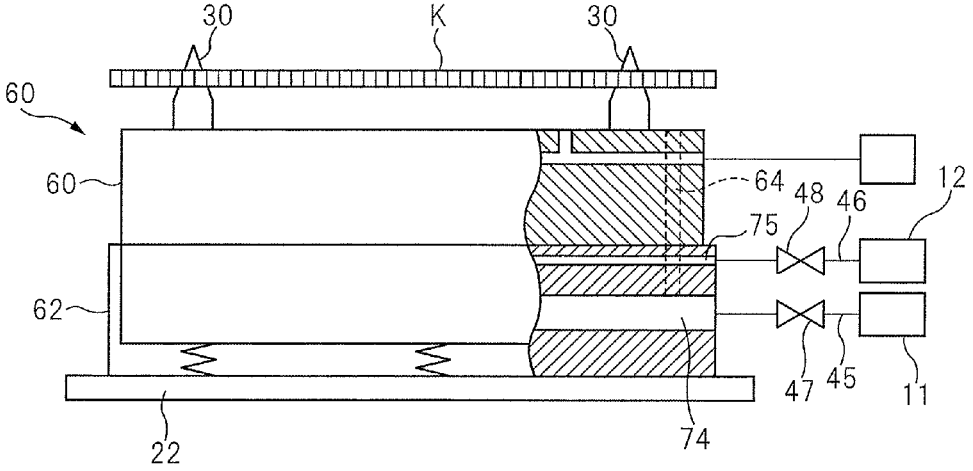
FIG. 7 is a lateral cross-sectional view which schematically shows the configuration of the bottom die which is used in a hot press forming die of a second embodiment.

FIG. 6 is a longitudinal cross-sectional view similar to FIG. 3 which schematically shows a bottom die 60 which is used in the hot press forming apparatus of the second embodiment, while FIG. 7 is a lateral cross-sectional view similar to FIG. 4 which schematically shows the bottom die 60. As shown in FIG. 6 and FIG. 7, the bottom die 60 has an outside die 61 which has a forming surface 61*a* which contacts the steel sheet K and an inside die 71 which is provided slidably with respect to the outside die 61 at the inside of the outside die 61. In the present embodiment, the inside die 71 has a rectangular cross-sectional shape. Note that, in FIG. 7, for convenience of illustration, the outside die 61 is drawn slightly shorter than the inside die 71 in the lateral direction of FIG. 7.

The outside die 61 is provided with a plurality of outside pipes 64 which run from the forming surface 61*a* which contacts the steel sheet K to the sliding surface 63 between the outside die 61 and inside die 71, through the inside of the outside die 61. The ends of the outside pipes 64 at the forming surface 61*a* sides, in the same way as the feed holes 41*a* of the first embodiment, act as feed holes 64*a* which feed fluid to the surface of the steel sheet K. Therefore, the outside pipes 64 can be said to be arranged between the feed holes 64*a* and the sliding surface 63. The forming surface 61*a*, like the forming surface 20*a* of the first embodiment, is formed with a plurality of projections.

Further, the outside die 61 is supported through elastic members 65 on the base 22. As the elastic members 65, for example, springs of predetermined stroke lengths are used. For this reason, if the top die 21 descends and pushes the outside die 61, the outside die 61 is guided by the sliding surface 63 while being pushed downward. The guide mechanism for sliding the outside die 61 and the inside die 71 may be provided separately from the sliding surface 63.

Inside of the inside die 71, a plurality of first inside pipes 72, a plurality of second inside pipes 73, a first header 74 which connects the plurality of first inside pipes 72 and coolant feed source 11, and a second header 75 which connects the plurality of second inside pipes 73 and gas feed source 12 are provided. The first inside pipes 72 are provided in the same number as the outside pipes 64 of the outside die 61 and run from the sliding surface 63 to the first header 74 through the inside of the inside die 71. The second inside pipes 73 are also provided in the same number as the outside pipes 64 of the outside die 61 and run from the sliding surface 63 to the second header 75 through the inside of the inside die 71.

The first header 74, as shown in FIG. 7, connects through the coolant feed pipe 45 to the coolant feed source 11 and therefore acts as a connecting part which is connected to the coolant feed source 11. On the other hand, the second header 75 connects through the gas feed pipe 46 to the gas feed source 12 and therefore acts as a connecting part which is connected to the gas feed source 12. The coolant feed pipe 45 is provided with the valve 47, while the gas feed pipe 46 is provided with the valve 48. The valve 47 and the valve 48, in the same way as the first embodiment, are connected to the control unit 13. The control unit 13 is used to operate the valve 47 and the valve 48 to open and close.

The ends of the second inside pipes 73 at the sliding surface 63 sides are arranged so as to be aligned with the ends of the outside pipes 64 at the sliding surface 63 sides in the state where the outside die 61 is not pushed by the top die 21. Conversely, the ends of the first inside pipes 72 at the sliding surface 63 sides are arranged so as not to be aligned with the ends of the outside pipes 64 at the sliding surface 63 sides in the state where the outside die 61 is not pushed by the top die 21. Therefore, in the state where the outside die 61 is not pushed by the top die 21, only the second inside pipes 73, that is, only the gas feed source 12, is connected to the outside pipes 64.

On the other hand, the ends of the first inside pipes 72 at the sliding surface 63 sides are arranged so as to be aligned with the ends of the outside pipes 64 at the sliding surface 63 sides in the state where the outside die 61 is pushed down to the bottom die limit by the top die 21. Conversely, the ends of the second inside pipes 73 at the sliding surface 63 sides are arranged so as not to be aligned with the ends of the outside pipes 64 at the sliding surface 63 sides in the state where the outside die 61 is pushed down to the bottom die limit by the top die 21. Therefore, in the state where the outside die 61 is pushed down to the bottom die limit by the top die 21, only the first inside pipes 72, that is, only the coolant feed source 11, is connected to the outside pipes 64.

In other words, in the present embodiment, the outside die 61 and the inside die 71 slide relative to each other linked with the operation of the top die 21. Due to this, it is possible to switch between a state where the outside pipes 64 are connected to the first inside pipes 72 and a state where they are connected to the second inside pipes 73. Note that, when with just the metal surfaces sliding together, it is difficult to seal in the coolant against the pressure of the coolant, the ends of the inside pipes 72 and 73 at the sliding surface 63 sides or the ends of the outside pipes 64 at the sliding surface 63 sides may be provided with rubber rings or other seal members.

Next, the method of using the thus configured hot press forming apparatus to hot press form steel sheet K will be explained.

First, when starting the press forming of the steel sheet K, the valve 48 which is provided at the gas feed pipe 46 is closed and the valve 47 which is provided at the coolant feed pipe 45 is opened. At this time, the outside die 61 is not pushed by the top die 21, and therefore is lifted by the elastic members 65. Therefore, the outside pipes 64 are connected, with the second inside pipes 73. For this reason, even if the valve 47 is opened, the coolant feed source 11 feeds coolant to the first inside pipes 72 at a predetermined pressure and does not feed coolant to the outside pipes 64. In other words, the coolant which is fed to the first inside pipes 72 is stopped by the sliding surface 63 of the outside die 61 and is filled at a predetermined pressure to the ends of the first inside pipes 72. On the other hand, the valve 48 is closed, and therefore even if the second inside pipes 73 and the outside pipes 64 are connected, the outside pipes 64 are not fed with gas.

Figure 8:
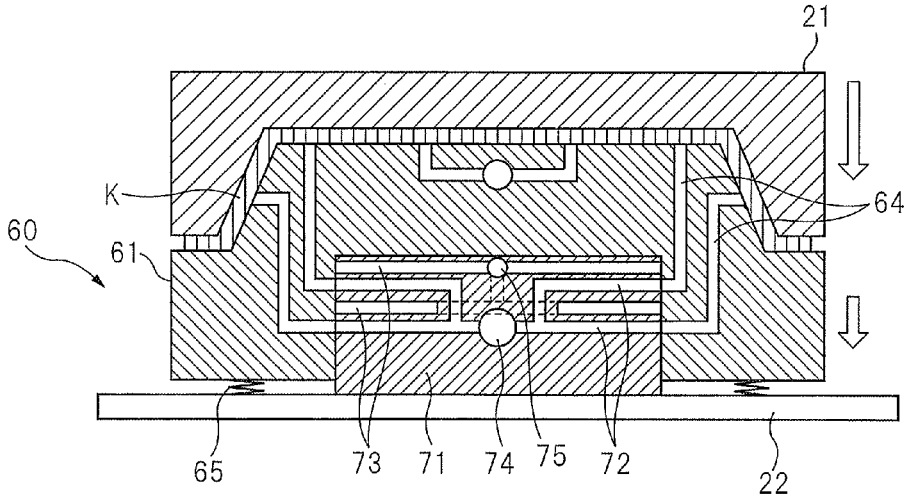
FIG. 8 is a view for explaining the state where the top die is pushed down to a bottom die limit.

Next, a high temperature steel sheet K is placed by a conveyor apparatus (not shown) on the positioning pins 30 of the bottom die 60. Next, the top die 21 is moved in the vertical direction so as to approach the bottom die 60 to, for example, as shown in FIG. 8, make it descend to the bottom die limit. Along with this, the steel sheet K and the outside die 61 of the bottom die 60 are pushed down in the vertical direction and the steel sheet K which is clamped between the top die 21 and the bottom die 60 is pressed.

At this time, the outside die 61 is pushed down to the bottom die limit, whereby the outside pipes 64 of the outside die 61 are disconnected from the second inside pipes 73 of the inside die 71 and are connected to the first inside pipes 72. Due to this, the coolant which had been filled to the end of the first inside pipes 72 is immediately fed from the outside pipes 64 to the steel sheet K. The steel sheet K starts to be rapidly cooled right after the steel sheet K is pressed.

Further, if the outside die 61 is pushed down to the bottom die limit and thereby the outside pipes 64 and the second inside pipes 73 are disconnected, the valve 48 which is provided at the gas feed pipe 46 is opened. For this reason, the second inside pipes 73 are fed with gas of a predetermined pressure. In other words, the coolant which was fed to the second inside pipes 73 is stopped by the sliding surface 63 of the outside die 61 and is filled at a predetermined pressure to the ends of the second inside pipes 73.

Further, if the top die 21 is held at bottom die limit for a certain time and the steel sheet K is cooled down to a temperature of for example 200° C. or less, next, the top die 21 is risen to top dead center. If the top die 21 rises to top die limit, the outside die 61 which was pushed down to the bottom die limit is pushed vertically upward by the elastic members 65 which support the outside die 61. As a result, the outside pipes 64 are disconnected from the first inside pipes 72 and are connected to the second inside pipes 73. For this reason, the feed of coolant from the outside pipes 64 to the steel sheet K is immediately stopped. In addition, the gas which filled up to the ends of the second inside pipes 73 is immediately fed from the outside pipes 64 to the steel sheet K, and therefore gas starts to be blown to the steel sheet K immediately after stopping the feed of the coolant. At this time, the pressure etc. of the gas which is fed from the feed holes 64*a* are set in the same way as in the first embodiment.

Further, when coolant finishes being removed from the surface of the steel sheet K by blowing gas to the surface of the steel sheet K, the shaped steel sheet K is removed by the conveyor apparatus (not shown) from the positioning pins 30 and is unloaded from the hot press forming apparatus. After this, a heated new steel sheet K is placed by the conveyor apparatus (not shown) on the positioning pins 30 of the hot press forming apparatus and this series of steps of the hot press forming operation are repeated.

Next, the advantageous effects of the hot press forming die and hot press forming method according to the above embodiment will be explained.

According to the present embodiment, the outside pipes 64 and the first inside pipes 72 and second inside pipes 73 are switched to be connected and disconnected by making the outside die 61 and the inside die 71 move relative to each other. Therefore, in the present embodiment, a fluid switching means for switching the fluid which is fed to the plurality of feed holes 64*a* between a coolant and gas can be said to be provided inside of the bottom die. For this reason, the outside pipes 64 and the first inside pipes 72 and second inside pipes 73 are switched to be connected and disconnected at positions close to the feed holes 64*a* which feed fluid (coolant and gas) to the steel sheet K. In other words, control may be performed to feed and stop the fluid at positions close to the forming surface 61*a* of the outside die 61, that is, positions close to the steel sheet K to which the fluid is to be fed.

For this reason, in the state where the second inside pipes 73 are closed by the sliding surface 63 of the outside die 61, the gas is fed in advance to the second inside pipes 73 to fill the gas up to the ends of the second inside pipes 73. After this, the outside die 61 can be pushed up to connect the outside pipes 64 and the second inside pipes 73. Due to this, the gas which had been filled in the second inside pipes 73 can be quickly blown from the outside pipes 64 to the steel sheet K. Therefore, compared with the first embodiment, it is possible to more quickly blow gas to the surface of the steel sheet K after stopping the feed of coolant to the surface of the steel sheet K.

Similarly, in the state where the first inside pipes 72 are closed by the sliding surface 63 of the outside die 61, the coolant is fed in advance to the first inside pipes 72 to fill the coolant up to the ends of the first inside pipes 72. After this, the outside die 61 can be pushed down to the bottom die limit to connect the outside pipes 64 and the first inside pipes 72. Due to this, coolant which is filled in the first inside pipes 72 can be quickly blown from the outside pipes 64 to the steel sheet K.

Further, for example, at the bottom die 60 which is shown in FIG. 4, for example, the total pipeline lengths from the valves 47 and 48 to the feed holes 41*a* closest to the valves 47 and 48 (feed holes at right side of FIG. 4) and the total pipeline lengths to the feed holes 41*a* furthest from the valves 47 and 48 (feed holes at left side of FIG. 4) greatly differ in length. For this reason, at the positions close to the valves 47 and 48 and the positions far from the valves 47 and 48, the timings of start of cooling of the steel sheet K and the timings of start of blowing of gas to the steel sheet K differ. As opposed to this, in the hot press forming apparatus of the present embodiment, it is possible to obtain similar effects to the case where valves are provided at the ends of the outside pipes 64 at the sliding surface 63 sides, and therefore it is possible to make the differences in pipeline lengths extremely small compared with the bottom die 60 which is shown in FIG. 4.

Note that, the outside pipes 64 of the outside die 61 are preferably the same in pipeline lengths. By making the outside pipes 64 the same in pipeline lengths, the times from connection of the outside pipes 64 and the inside pipes 72 and 73 to the start of feed of coolant or gas to the steel sheet K become the same. In this case, it is possible to make the timings of start of cooling and the timings of start of blowing of gas uniform over the surface of the steel sheet K. As a result, the hardness of the steel sheet K after hot press forming can be uniform over the surface.

Note that, the bottom die 60 of the second embodiment can be changed in various ways. Below, modifications of the bottom die 60 are shown.

Figure 9:
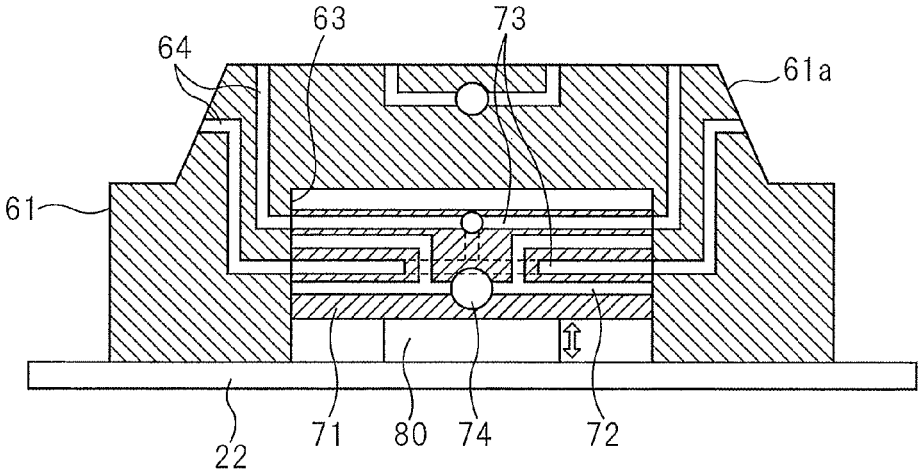
FIG. 9 is a longitudinal cross-sectional view which schematically shows the configuration of the bottom die according to a modification of the second embodiment.

In the above embodiments, the outside die 61 which is supported by the elastic members 65 is pushed down by the top die 21 whereby the outside die 61 is slid against the inside die 71. However, if the outside die 61 and the inside die 71 can be slid relative to each other, the inside die 71 can be slid and, further, both the outside die 61 and the inside die 71 can be slid. When making the inside die 71 side, for example as shown in FIG. 9, the outside die 61 may be directly arranged on the top surface of the base 22 and the inside die 71 may for example be slide by an actuator or other drive mechanism 80 in the up-down direction. In this case, the timing of ending the press operation of the steel sheet K and the timing of start of feed of the coolant can be separately controlled.

Further, when using the drive mechanism 80, the state where the ends of the outside pipes 64 at the sliding surface 63 sides are connected with the first inside pipes 72, the state where the ends of the outside pipes 64 at the sliding surface 63 sides are connected with the second inside pipes 73, and, in addition, the state where the ends of the outside pipes 64 at the sliding surface 63 sides are not connected to either the first inside pipes 72 and second inside pipes 73 (that is, the state where the ends of the outside pipes 64 at the sliding surface 63 sides face the inside wall surface of the inside die 71) can be switched between. In this case, the valves 47 and 48 no longer need be provided.

Figure 10:
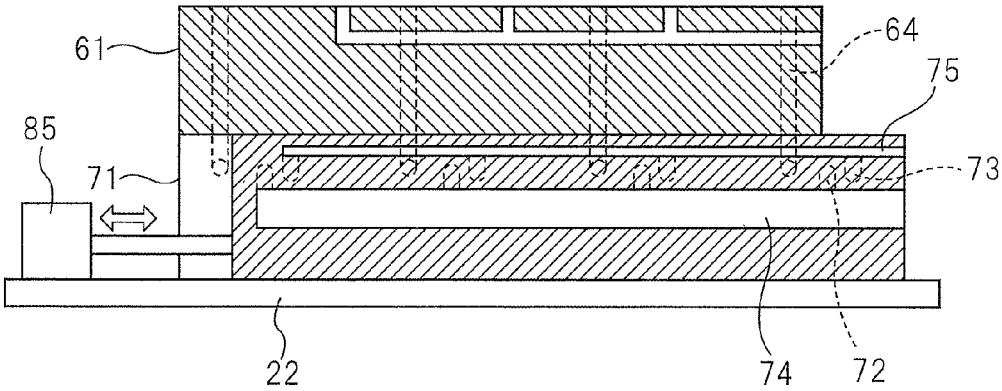
FIG. 10 is a lateral cross-sectional view which schematically shows the configuration of a bottom die according to a modification of the second embodiment.

Further, in the above embodiments, the dies 61 and 71 were slid in the up-down direction to connect the outside pipes 64 and the inside pipes 72 and 73. However, the arrangements of the pipes 64, 72, and 73 and the directions of relative sliding of the dies 61 and 71 are not limited to those of the present embodiments and can be freely set. For example, when making the dies 61 and 71 slide in the horizontal direction, as shown in FIG. 10, it is possible to arrange the outside die 61 and the inside die 71 offset in the horizontal direction and shift the inside pipes 72 and 73 from the corresponding outside pipes 64 in the horizontal direction. Further, for example, it is possible to slide the inside die 71 in the horizontal direction by the horizontal movement mechanism 85 so as to connect the first inside pipes 72 and the outside pipes 64 or connect the second inside pipes 73 and the outside pipes. Further, for example, it is possible to make the inside die 71 substantially cylindrical in shape and to slide the inside die 71 in the circumferential direction so that the inside pipes 72 and 73 and the outside pipes 64 are connected.

Figure 11:
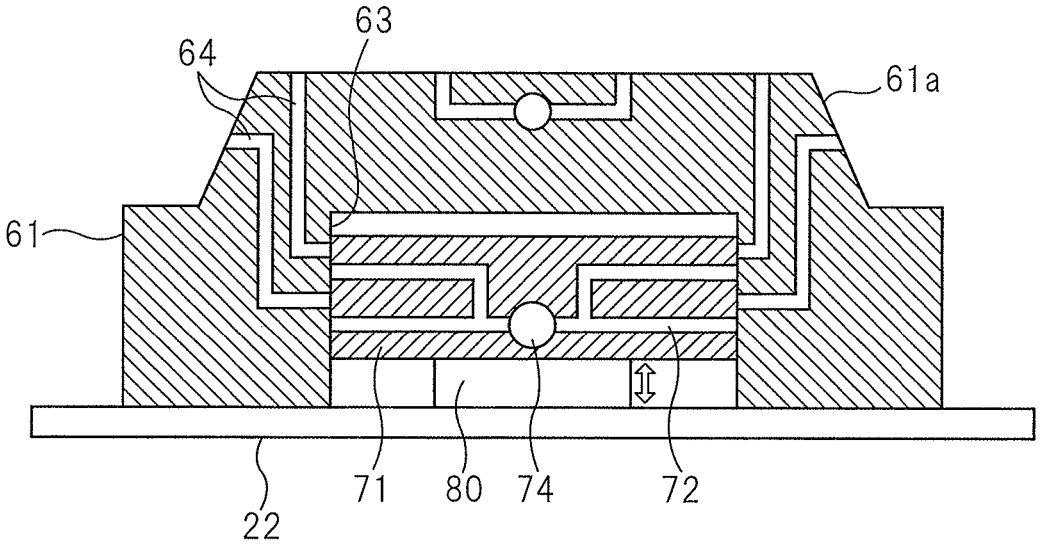
FIG. 11 is a longitudinal cross-sectional view which schematically shows the configuration of a bottom die according to a modification of the second embodiment.

Alternatively, as shown in FIG. 11, the inside die 71 need not be provided with the second inside pipes 73 and second header 75 and may be provided with only the first inside pipes 72 and first header 74. In this case, the first header 74, in the same way as the header 40 of the first embodiment, may be connected to both the coolant feed source 11 and gas feed source 12. When configuring the inside die 71 in this way, the feed of coolant is started by using the drive mechanism 80 to slide the inside die 71 with respect to the outside die 61, but the feed of gas is started by controlling the operation of the valves 47 and 48.

Note that, in the above embodiments, the bottom die 60 was configured by an outside die 61 and an inside die 71, but the top die 21 may be configured by an outside die and inside die. Alternatively, both the bottom die 60 and the top die 21 may be configured by outside dies and inside dies. Further, the die comprised of the outside die and inside die may be used for either the projecting die and recessed die which are used for press forming or may be used for both of the projecting die and recessed die.

Further, in the above embodiments, the inside die 71 was provided with only a single header for each kind of fluid, but it is also possible to provide a plurality of headers for each kind of fluid. In this case, for example, taking a coolant as an example, when stopping the feed of coolant to one part of the headers, it is possible to stop the feed of coolant from the first inside pipes 72 and outside pipes 64 which are connected to the first headers 74 to which feed has been stopped, and continue the feed of coolant from the remaining first inside pipes 72 and outside pipes 64. That is, it is possible to selectively stop the feed of coolant. Due to this, it is possible to control the portions of the steel sheet K which are fed with coolant and change the hardness in the plane of the steel sheet K.

Further, in the above embodiments, the hot press forming operation of the steel sheet K as explained, but the invention can also be used for hot press forming a metal sheet other than steel sheet.

Note that, the present invention was explained in detail based on specific embodiments, but a person skilled in the art can make various changes, corrections, etc. without departing from the claims and concept of the present invention.

INDUSTRIAL APPLICABILITY

The present invention is useful when hot press forming steel sheet.

REFERENCE SIGNS LIST

1 hot press forming apparatus
10 hot press forming die
11 coolant feed source
12 gas feed source
13 control unit
20 bottom die
20*a* forming surface
21 top die
22 base
23 lift mechanism
30 positioning pin
40 header
41 pipe
42 projection
60 bottom die
61 outside die
63 sliding surface
64 outside pipe
71 inside die
72 first inside pipe
73 second inside pipe
74 first header
75 second header
K steel sheet
P prepierced hole

The invention claimed is:

1. A hot press forming method which shapes a heated metal sheet using a forming die which is comprised of a first die and a second die, comprising steps of:

arranging the heated metal sheet between said first die and said second die;

making said first die and said second die approach to press the metal sheet which is clamped between the two dies;

after pressing said metal sheet, feeding liquid state or mist state coolant to the surface of the metal sheet which is clamped between the two dies through a plurality of feed holes which are provided at least at one of said first die and said second die; and, after said coolant finishes being fed, blowing a gas through said plurality of feed holes to the surface of the metal sheet, wherein said first die and second die are separated before feeding said gas to the surface of the metal sheet.

2. The hot press forming method as set forth in claim 1 wherein a fluid switch for switching said coolant and said gas which are fed to said plurality of feed holes is provided inside at least one of said first die and second die.

3. The hot press forming method as set forth in claim 2 wherein at least one of said first die and said second die has an outside die at which said feed holes are provided and an inside die which is arranged slidably inside said outside die;

said outside die is provided inside it with outside pipes which are arranged between a sliding surface between the outside die and said inside die, and said feed holes;

said inside die is provided inside it with first inside pipes which are arranged between said sliding surface and a connecting part which is connected to a coolant feed source and with second inside pipes which are arranged between said sliding surface and a connecting part which is connected to a gas feed source; and said fluid switch makes said outside die and said inside die slide relative to each other to connect said outside pipes with the first inside pipes or second inside pipes and thereby switch between said coolant and said gas which is fed to said plurality of feed holes.

4. The hot press forming method as set forth in claim 2 wherein said coolant is either water or anti-rust oil.

5. The hot press forming method as set forth in claim 3 wherein said coolant is either water or anti-rust oil.

6. The hot press forming method as set forth in claim 1 wherein said coolant is either water or anti-rust oil.

7. A hot press forming die which presses and cools a heated metal sheet, comprising:

an outside die provided with feed holes which feed fluid to said metal sheet; and an inside die which is arranged slidably inside said outside die, wherein said outside die is provided inside it with outside pipes which are arranged between a sliding surface between the outside die and said inside die and said feed holes;

said inside die is provided inside it with first inside pipes which are arranged between said sliding surface and a connecting part which is connected to a coolant feed source and with second inside pipes which are arranged between said sliding surface and a connecting part which is connected to a gas feed source; and said outside pipes, first inside pipes, and second inside pipes are formed so that said outside pipes can be switched between at least a state connected to the first inside pipes and a state connected to the second inside pipes by making said outside die and said inside die move relative to each other.

8. The hot press forming die as set forth in claim 7 wherein said outside pipes, first inside pipes, and second inside pipes are formed so that said outside pipes can be switched between a state connected to the first inside pipes, a state connected to the second inside pipes, and a state not connected to the two inside pipes, by making said outside die and said inside die move relative to each other.

9. The hot press forming die as set forth in claim 8 wherein the pipeline lengths of the outside pipes are equal.

10. The hot press forming die as set forth in claim 8 wherein the die which is comprised of said inside die and said outside die is used as at least one of a top die and bottom die for press forming.

11. The hot press forming die as set forth in claim 7 wherein the pipeline lengths of the outside pipes are equal.

12. The hot press forming die as set forth in claim 11 wherein the die which is comprised of said inside die and said outside die is used as at least one of a top die and bottom die for press forming.

13. The hot press forming die as set forth in claim 7 wherein the die which is comprised of said inside die and said outside die is used as at least one of a top die and bottom die for press forming.

14. The hot press forming die as set forth in claim 7 wherein said coolant is any of water, an anti-rust oil, and mists of the same.

* * * * *